US010533390B2

(12) United States Patent
Vasques et al.

(10) Patent No.: US 10,533,390 B2
(45) Date of Patent: Jan. 14, 2020

(54) ANNULAR BARRIER HAVING A DOWNHOLE EXPANDABLE TUBULAR

(71) Applicant: Welltec Oilfield Solutions AG, Zug (CH)

(72) Inventors: Ricardo Reves Vasques, Allerød (DK); Dean Richard Massey, Allerød (DK)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 132 days.

(21) Appl. No.: 15/164,156

(22) Filed: May 25, 2016

(65) Prior Publication Data

US 2016/0348463 A1 Dec. 1, 2016

(30) Foreign Application Priority Data

May 26, 2015 (EP) ..... 15169291
Jun. 24, 2015 (EP) ..... 15173632

(51) Int. Cl.
*C21D 8/10* (2006.01)
*C21D 9/00* (2006.01)
*E21B 33/127* (2006.01)

(52) U.S. Cl.
CPC ..... *E21B 33/1277* (2013.01); *C21D 8/105* (2013.01); *C21D 9/0068* (2013.01); *E21B 33/127* (2013.01)

(58) Field of Classification Search
CPC ..... E21B 33/127; E21B 33/1277
See application file for complete search history.

(56) References Cited

U.S. PATENT DOCUMENTS 2,292,363 A 8/1942 Crawford
4,001,054 A 1/1977 Makepeace
(Continued)

FOREIGN PATENT DOCUMENTS

CA 2 470 592 12/2004
EP 2 538 018 A1 12/2012
(Continued)

OTHER PUBLICATIONS

Extended EP Search Report for EP15173632.9 dated Sep. 9, 2015, 6 pages.
(Continued)

*Primary Examiner* — David J Bagnell
*Assistant Examiner* — Dany E Akakpo
(74) *Attorney, Agent, or Firm* — Nixon & Vanderhye P.C.

(57) ABSTRACT

An annular barrier has a tubular part, and a downhole expandable tubular to be expanded in an annulus downhole from a first outer diameter to a second outer diameter to abut against an inner face of a casing or borehole. The downhole expandable tubular has a first end section, a second end section and an intermediate section between the first end section and the second end section, the downhole expandable tubular surrounding the tubular part. Each end section of the downhole expandable tubular is connected with the tubular part and extends along a longitudinal axis, and defines an annular barrier space between the tubular part and the downhole expandable tubular. The tubular is made from one metal tubular blank of one metal material, the metal material of the end sections having a higher yield strength than the metal material of the intermediate section.

18 Claims, 12 Drawing Sheets

(56) References Cited

U.S. PATENT DOCUMENTS

| | | | | |
|---|---|---|---|---|
| 7,347,274 | B2 * | 3/2008 | Patel | E21B 33/128 166/120 |
| 2006/0027371 | A1 * | 2/2006 | Gorrara | E21B 33/12 166/313 |
| 2007/0114044 | A1 | 5/2007 | Brezinski et al. | |
| 2013/0105158 | A1 | 5/2013 | Saltel | |

FOREIGN PATENT DOCUMENTS

| | | | | |
|---|---|---|---|---|
| WO | WO 2011/056394 | A2 | 5/2011 | |
| WO | WO-2012175695 | A1 * | 12/2012 | E21B 33/12 |

OTHER PUBLICATIONS

International Search Report and Written Opinion dated Jul. 28, 2016 in International Application No. PCT/EP2016/061761 (11 pages).
Notification of the First Office Action dated Jun. 27, 2019 in Chinese Application No. 201680030247.5, with English translation, 16 pages.
Examination Report No. 3 for Standard Patent Application dated Jul. 16, 2019 in Australian Application No. 2016266713, 4 pages.

* cited by examiner

ANNULAR BARRIER HAVING A DOWNHOLE EXPANDABLE TUBULAR

CROSS-REFERENCE

This application claims priority to EP Patent Application No. 15169291.0 filed on 26 May 2015 and EP Patent Application No. 15173632.9 filed on 24 Jun. 2015, the entire contents of each of which are hereby incorporated by reference.

FIELD OF THE TECHNOLOGY

The present technology relates to an annular barrier to be expanded in an annulus between a well tubular structure and an inside face of a casing or borehole downhole for providing zone isolation between a first zone and a second zone of the casing or borehole. The present technology furthermore relates to an annular barrier to be expanded in an annulus, to a downhole completion system and to a manufacturing method for the manufacture of the downhole expandable tubular according to the present invention.

BACKGROUND ART

In some completions, annular barriers are often used for providing zone isolation, i.e. isolation of production zones from non-producing zones. The annular barriers are mounted as part of the well tubular structure, and an expandable sleeve of the annular barrier is arranged around the well tubular structure and is expanded to provide the zone isolation. In some wells, the annular space surrounding the annular barrier is so limited that the expandable sleeve cannot be mounted by means of connection sleeve parts surrounding the expandable sleeve to fasten the expandable sleeve to the base pipe. A mere welding of the ends of the expandable sleeve to the base pipe does not suffice, since tests have shown that there is a risk that the expandable sleeve will rupture or depart from the base pipe. This is due to the fact that the connection sleeve parts prevent free expansion of the expandable sleeve and thus limit the risk of the expandable sleeve rupturing during expansion.

SUMMARY OF THE TECHNOLOGY

It is an aspect of the present invention to wholly or partly overcome the above disadvantages and drawbacks of the prior art. More specifically, it is an aspect to provide an improved expandable tubular which can be expanded without rupturing and without the use of parts preventing free expansion.

A further aspect is to provide an improved annular barrier which has a limited outer diameter without decreasing the expansion ability of the expandable tubular of the annular barrier.

The aboveaspects, together with numerous otheraspects, advantages and features, which will become evident from the below description, are accomplished by a solution in accordance with the present technology by an annular barrier to be expanded in an annulus between a well tubular structure and an inside face of a casing or borehole downhole for providing zone isolation between a first zone and a second zone of the casing or borehole, the annular barrier having a longitudinal axis and comprising:

a tubular part, the tubular part being a separate tubular part or a casing part for mounting as part of the well tubular structure, a downhole expandable tubular to be expanded in the annulus downhole from a first outer diameter to a second outer diameter to abut against the inner face of the casing or borehole, the downhole expandable tubular extending along the longitudinal axis, a first end section, a second end section and an intermediate section between the first end section and the second end section, and the downhole expandable tubular surrounding the tubular part, each end section of the downhole expandable tubular being connected with the tubular part and extending along the axial extension, and an annular barrier space between the tubular part and the downhole expandable tubular, wherein the downhole expandable tubular comprises one piece construction of metal material, the end sections (or metal material thereof) having a higher yield strength than the intermediate section (or metal material thereof).

Further, the end sections of the downhole expandable tubular may be welded onto the tubular part.

Additionally, the metal material of the end sections may have a higher yield strength than the metal material of the intermediate section after metal-working of the end sections and/or the intermediate section.

Further, metal-working may be performed by means of one of the following processes: cold-working, heat-treating, annealing, induction-annealing or any combination thereof.

Moreover, the end sections may be cold-worked or the intermediate section may be heat-treated, annealed or induction-annealed.

The end sections may be metal-worked so that the metal material of the end sections has a higher yield strength than the metal material of the intermediate section.

Also, the yield strength of the metal material of the end sections may be at least 25% higher than the yield strength of the material of the intermediate section, preferably at least 40% higher than the yield strength of the material of the intermediate section, and more preferably at least 50% higher than the yield strength of the material of the intermediate section.

Furthermore, the downhole expandable tubular may subsequently be machined, providing the downhole expandable tubular with at least one groove.

Said machining may be performed by milling, cutting, grinding or lathing.

Moreover, the yield strength of the metal material of the end sections may be at least 350 MPa at room temperature.

Additionally, the metal tubular blank may be cast or be made by centrifugal or spin casting.

The end sections and the intermediate section may have substantially the same thickness along the axial extension.

Also, the metal tubular blank may be made from steel or stainless steel.

Further, the intermediate section may comprise subsections having a higher yield strength than the intermediate section.

The yield strength of the subsections may be lower than that of the end sections.

Moreover, the subsections may be distributed along the axial extension of the intermediate section with a predetermined distance between them.

Furthermore, the intermediate section may extend between the subsections, so that the expandable tubular has varying yield strengths along the axial extension.

In addition, the metal tubular blank may have an inner diameter and an outer diameter, said blank being machined so as to increase the inner diameter and/or decrease the outer diameter.

Also, the downhole expandable tubular may have a length and the downhole expandable tubular may be machined along the entire length.

The downhole expandable tubular may comprise several projections and/or at least one groove.

Additionally, a sealing element may be arranged between two adjacent projections or in the groove.

Said sealing element may be made of an elastomer, rubber, polytetrafluoroethylene (PTFE) or another polymer.

Moreover, a ring-shaped retaining element may be arranged between two adjacent projections or in the groove for pressing the sealing element in the axial extension towards an edge of the projection or groove.

The ring-shaped retaining element may be a split ring.

Furthermore, a back-up element may be arranged between the ring-shaped retaining element and the sealing element.

Further, the intermediate element may be made of polytetrafluoroethylene (PTFE) or polymer.

Also, the downhole expandable tubular may be part of a liner hanger to be expanded within a casing or well tubular structure in a well, or a casing to be expanded within another casing.

In addition, the metal tubular blank may have an outer blank diameter which is larger than the first outer diameter.

Moreover, the metal tubular blank may have a blank thickness which is larger than a thickness of the expandable tubular when metal-working has been performed.

The annular barrier according to the present invention may comprise an expansion opening in the tubular part through which fluid may enter the space in order to expand the expandable tubular.

The tubular part may be made of metal.

Hereby, a slim design of the annular barrier may be obtained, which facilitates submersions and renders the annular barrier capable of also fitting into smaller boreholes.

The end sections of the downhole expandable tubular may be shrinked onto the tubular part.

Also, the end sections of the downhole expandable tubular may be connected with the tubular part by means of connection parts. The connection parts may be configured to protect the downhole expandable tubular when it is being submerged.

The annular barrier as described above may further comprise at least one sealing element surrounding the downhole expandable tubular.

Moreover, a sleeve may be arranged between the downhole expandable tubular and the tubular part, the sleeve being connected with the tubular part and the downhole expandable tubular, thereby dividing the space into a first space section and a second space section.

Further, the downhole expandable tubular may have an opening providing fluid communication between the first zone or the second zone and one of the space sections.

The projection may be a ring-shaped projection of an increased thickness in relation to other parts of the downhole expandable tubular, the ring-shaped projection providing an enforcement of the annular barrier when the annular barrier is expanded.

The present technology also relates to a downhole completion system comprising:

a well tubular structure, and an annular barrier as described above.

The tubular part of the annular barrier may be mounted as part of the well tubular structure.

Also, the completion system may comprise a plurality of annular barriers.

Finally, the present invention relates to a manufacturing method for manufacturing the downhole expandable tubular according to the present invention, comprising the steps of:

providing a metal tubular blank made of a metal material, and metal-working the end sections or the intermediate section so that the metal material of the end sections has a higher yield strength than the metal material of the intermediate section.

In the manufacturing method as described above, the step of metal-working may comprise the steps of cold-working the intermediate section to a thickness which is smaller than that of the end sections, heat-treating the intermediate section and cold-working the end sections.

Furthermore, the step of metal-working may comprise the steps of cold-working the intermediate section and the end sections and heat-treating the intermediate section.

The heat-treatment of the intermediate section may be performed by annealing, e.g. induction-annealing.

The method as described above may further comprise the step of machining the downhole expandable tubular, thereby providing it with at least one circumferential projection or groove.

BRIEF DESCRIPTION OF THE DRAWINGS

The present technology and its many advantages will be described in more detail below with reference to the accompanying schematic drawings, which for the purpose of illustration show some non-limiting examples and in which.

All the figures are highly schematic and not necessarily to scale, and they show only those parts which are necessary in order to elucidate the invention, other parts being omitted or merely suggested.

DETAILED DESCRIPTION OF THE PRESENT TECHNOLOGY

The present technology is described in relation to several non-limiting examples, aspects of which may be combined with one another.

Figure 1:
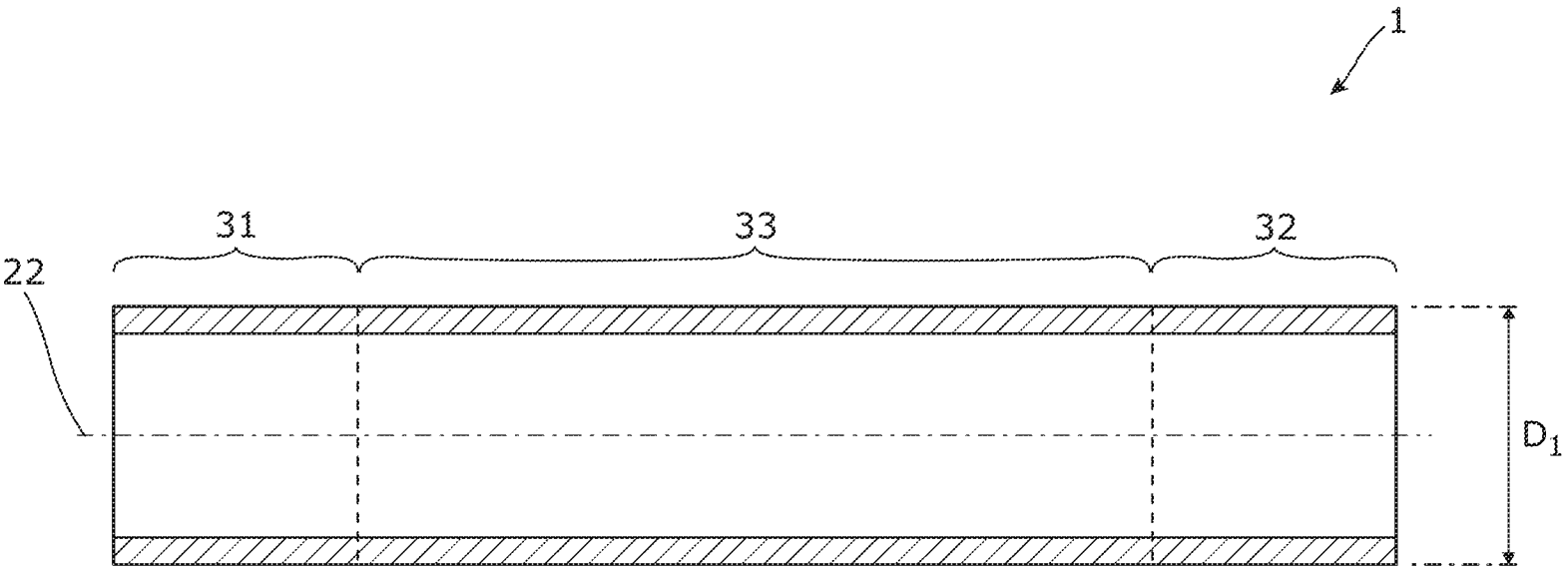
FIG. 1 shows a cross-sectional view of a downhole expandable tubular.
Figure 5:
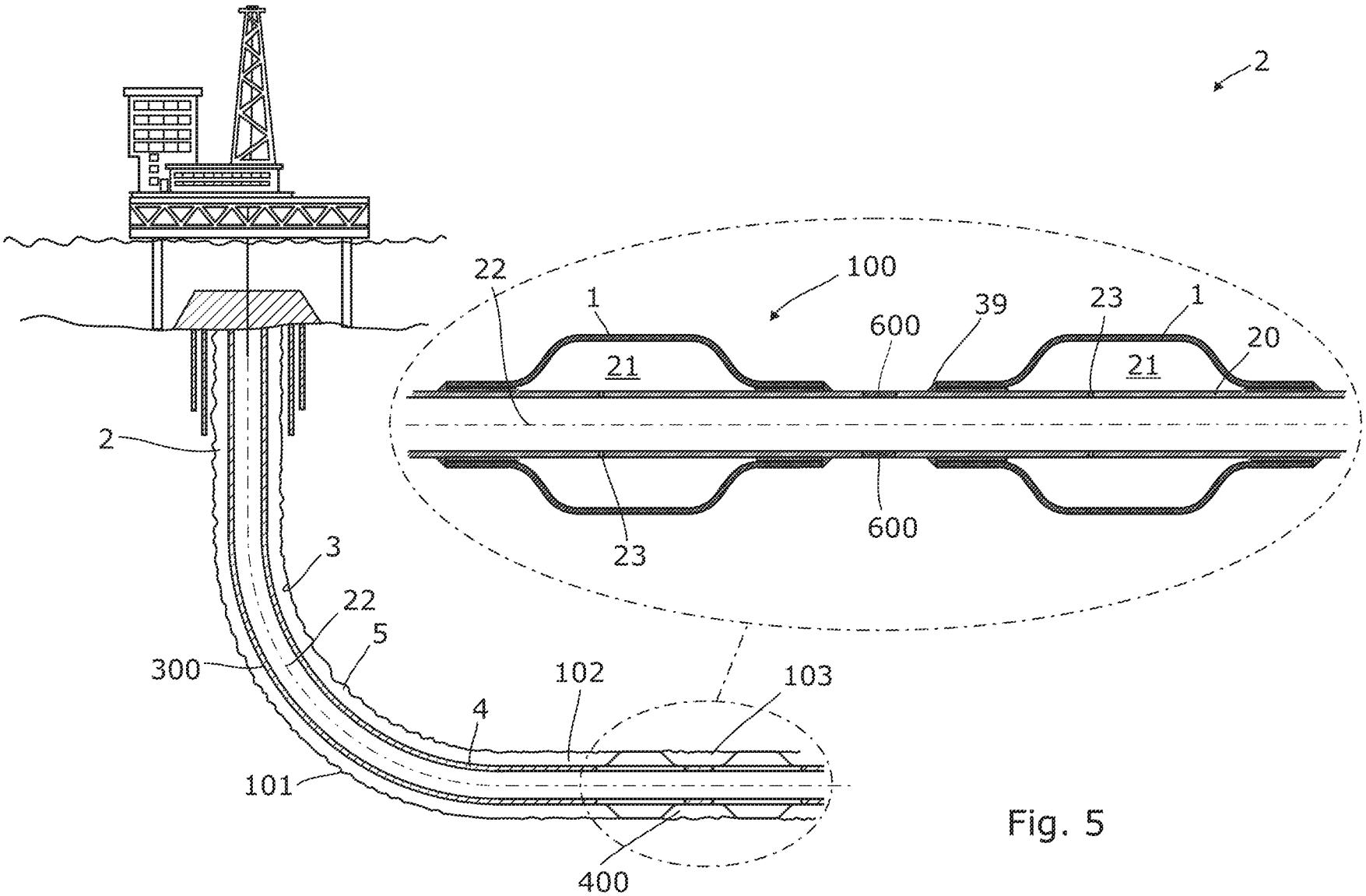
FIG. 5 shows a downhole completion system having an annular barrier with a downhole expandable tubular.

FIG. 1 shows a cross-sectional view of a downhole expandable tubular 1 to be at least partly expanded in a well 2 (as shown in FIG. 5) downhole from a first outer diameter $D_1$ to a second outer diameter $D_2$ (shown in FIGS. 6 and 12) to abut against an inner face of a casing or borehole. The downhole expandable tubular extends along a longitudinal axis 22, and along the axis, the downhole expandable tubular has a first end section 31, a second end section 32, and an intermediate section 33 between the first end section and the second end section. The downhole expandable tubular 1 is made from one metal tubular blank 6 (shown in FIG. 2) of one metal material, e.g. is a one piece construction made from a homogeneous metal material, as seen in cross section, including the end sections and the intermediate section. The metal material of the blank has the same properties through-out the metal tubular blank. The metal material of the end sections 31, 32 has a higher yield strength than the metal material of the intermediate section after metal-working of the end sections 31, 32 and/or the intermediate section 33, so that when expanded, the end sections are more reluctant to expand.

When using the downhole expandable tubular 1 as an expandable sleeve 1 of an annular barrier (shown in FIG. 6), connection parts 30 (shown in FIG. 12) connecting the expandable sleeve to the tubular part or base pipe and controlling the expansion of the ends of the expandable sleeve are no longer required, since the restriction in expansion is thus incorporated in the end sections of the downhole expandable tubular in the form of the expandable sleeve. This is due to the fact that the end sections (e.g. the metal material thereof) have a higher yield strength than the intermediate section (e.g. the metal material thereof), so that the end sections restrict and control the expansion at the ends, while the intermediate section of the expandable sleeve/downhole expandable tubular 1 is not restricted during expansion and can therefore comply with the requested expansion ratio. The ends of the downhole expandable tubular 1 can therefore be fastened to the tubular part of the annular barrier by a simple welded connection 39 (shown in FIG. 6), and the end sections having a higher yield strength thus prevent these ends from departing from the tubular part and destroying the welded connection. Such a simple design with welded ends is especially useful when manufacturing an annular barrier having a small outer diameter, since the connection parts take up more space than the downhole expandable tubular 1 which is welded directly to the tubular part.

The metal-working is performed by means of one of the following processes: cold-working, heat-treating, annealing, induction-annealing or any combination thereof. To obtain end sections having a higher yield strength than the intermediate section, the end sections are cold-worked and/or the intermediate section is heat-treated, annealed or induction-annealed. Thus, the end sections may be metal-worked, so that the metal material of the end sections has a higher yield strength than the metal material of the intermediate section. The yield strength of the metal material of the end sections is at least 25% higher than the yield strength of the material of the intermediate section, preferably at least 40% higher than the yield strength of the material of the intermediate section, and more preferably at least 50% higher than the yield strength of the material of the intermediate section. The yield strength of the metal material of the end sections is at least 350 MPa at room temperature.

Figure 2:
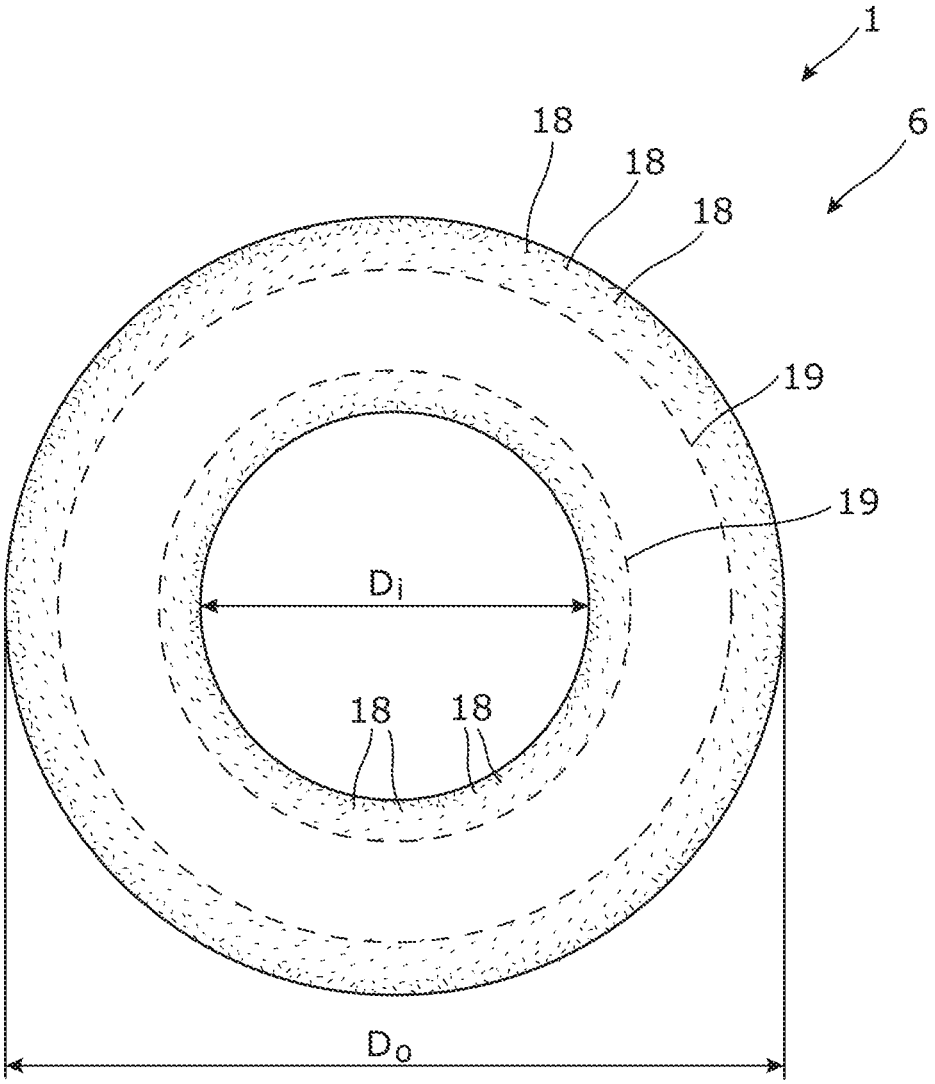
FIG. 2 shows a metal tubular blank seen from one end.
Figure 3:
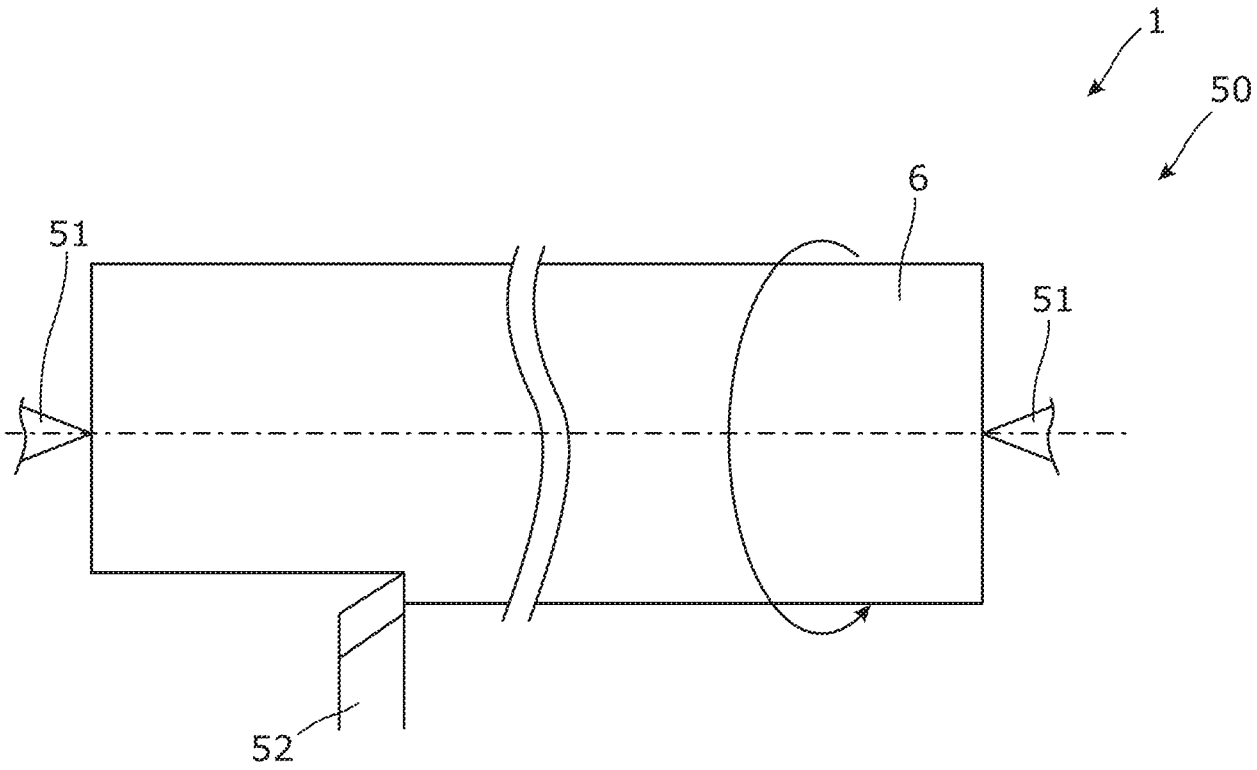
FIG. 3 shows part of a lathe machine machining a metal tubular blank.

The metal tubular blank 6 may be cast, such as made by spin or centrifugal casting. As the material cools down or is quenched, the metal tubular blank is formed from one end, as shown in FIG. 2. Impurities 18 in the material are located near the surface of the blank, and as the blank is machined and material is removed to form the downhole expandable tubular having projections, as shown in FIG. 3, the impurities are also removed, leaving a tubular to have a very low content of impurities. This tubular made of a very uniform material or "pure" material with a low content of impurities is indicated with dotted lines 19 in FIG. 2. The material with the low content of impurities has a higher ductility than the border material having a higher impurity content. The metal tubular blank may also be cold-worked or heat-treated without the blank first being machined.

One way of obtaining a downhole expandable tubular with end sections having a higher yield strength is to cold-work the intermediate section of the metal tubular blank into a thickness which is smaller than that of the end sections, then heat-treat the intermediate section, and subsequently cold-work the end sections into having a higher yield strength than the intermediate section.

Another way of obtaining a downhole expandable tubular with end sections having a higher yield strength is to cold-work the intermediate section and the end sections of the metal tubular blank into a thickness which is smaller than that of the blank, and then heat-treat the intermediate section, e.g. by means of annealing or induction-annealing, whereby the intermediate section obtains a lower yield strength than the end sections.

The yield strength along the axial extension of the downhole expandable tubular is thus controlled so as to match the need to control the radial expansion of e.g. an annular barrier providing isolation of a zone 103, such as a production zone 400, as shown in FIG. 5. In FIG. 5, two annular barriers 100 are used to isolate the production zone 400. A fracturing valve or section 600, also called a frac port, is arranged between the annular barriers, so that when the annular barriers have been expanded, the frac port 600 is opened, and fluid is let into the formation for creating fractures in the formation to ease the flow of hydrocarbon-containing fluid, such as oil, into the well tubular structure. The fracturing valve or section 600 may also comprise an inlet section which may be the same as the frac port. A screen may be arranged so that the fluid is filtered before flowing into the casing. Both annular barriers have downhole expandable tubulars as expandable sleeves, the downhole expandable tubulars being connected to the tubular part of the annular barrier by means of a welded connection in each end. The annular barriers are expanded by pressurising the well tubular structure 4 and allowing the pressurised fluid to enter through expansion openings 23 in the tubular part and thus hydraulically expand the downhole expandable tubular. The end sections of the downhole expandable tubular 1 form the transition from a fully extended sleeve to the welded connection to the tubular part.

Figure 4:
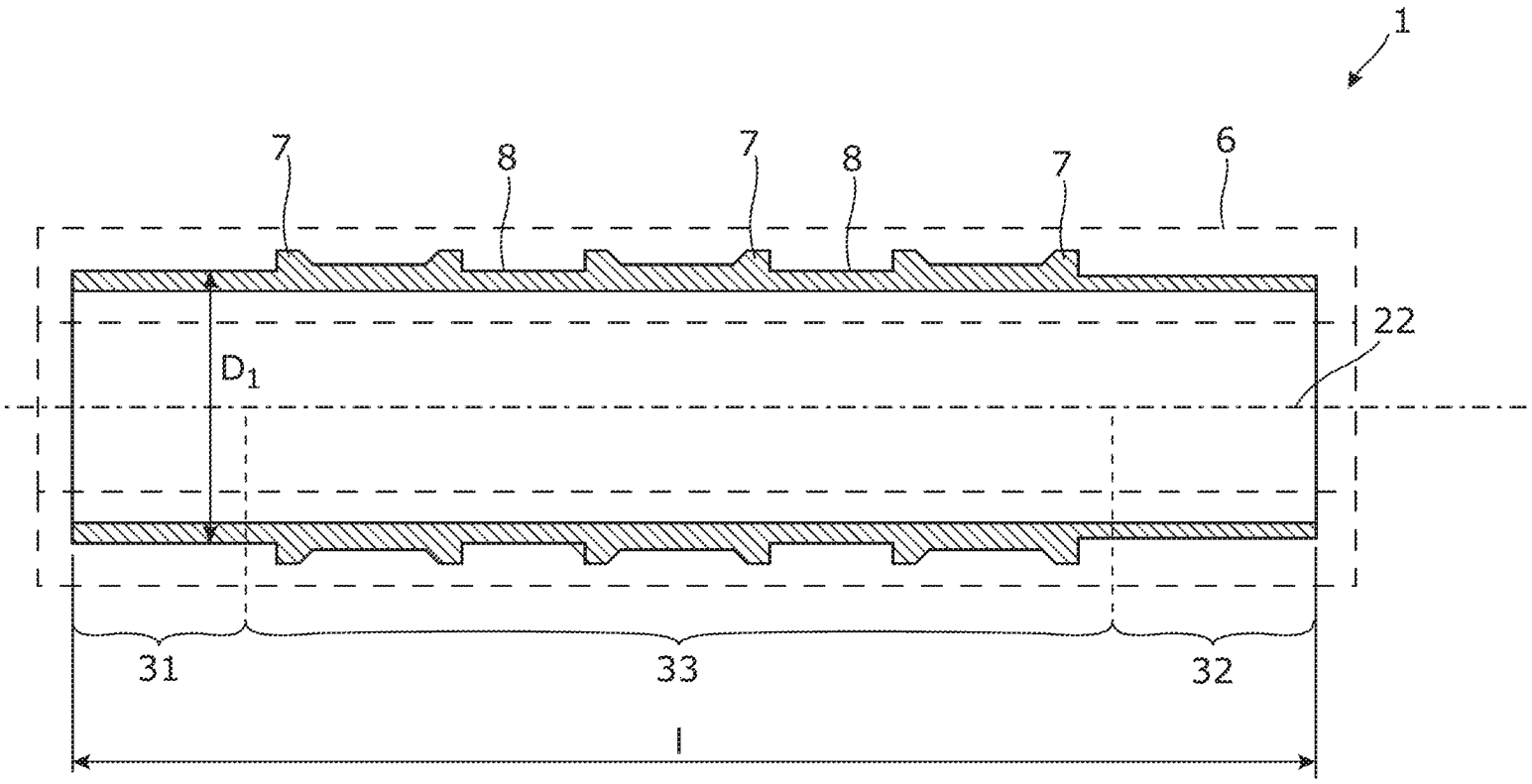
FIG. 4 shows a cross-sectional view of a machined downhole expandable tubular.

After processing the downhole expandable tubular with end sections having a higher yield strength by means of cold-working and/or heat-treatment, the downhole expandable tubular may be machined, providing it with at least one circumferential projection or groove 8, as shown in FIG. 4. In FIG. 4, the downhole expandable tubular 1 has six projections 7 and two grooves 8, and the blank is indicated with dotted lines illustrating the material which has been metal-worked and maybe also machined away to form the downhole expandable tubular 1 in one piece without subsequent use of connection parts or welded connection of rings creating projections and grooves. Hence, the downhole expandable tubular is merely fastened at its ends to the tubular part by a simple welded connection.

By machining the downhole expandable tubular from a blank having a substantially larger wall thickness, the downhole expandable tubular can be made with increased thickness, projections and grooves without having to weld rings onto the downhole expandable tubular, which may result in the subsequent deterioration of the expansion ability of the downhole expandable tubular.

The tubular blank of FIG. 2 has an inner diameter $D_i$ and an outer diameter $D_o$, and the blank may be machined so as to increase the inner diameter $D_i$ and decrease the outer diameter $D_o$ to remove the material with the highest content of impurities. The machining is performed by means of milling, cutting, grinding, lathing or by means of similar machining methods for removing material from the blank to form the downhole expandable tubular. In FIG. 3, metal material is being removed from the tubular blank in a lathe machine 50 to form the expandable tubular 1. The tubular blank is fastened between two points 51, and a lathe bit 52 machines material away from the blank 6. As shown in FIG. 3, the tubular blank may be a solid cylinder or a hollow cylinder, as shown in FIG. 2. The tubular blank can be made of any suitable metal material, such as steel or stainless steel. As can be seen in FIG. 4, the downhole expandable tubular has a length l, and the downhole expandable tubular 1 is machined along the entire length, thus removing material from the blank to form the downhole expandable tubular 1 of a "pure" material.

Figure 6:
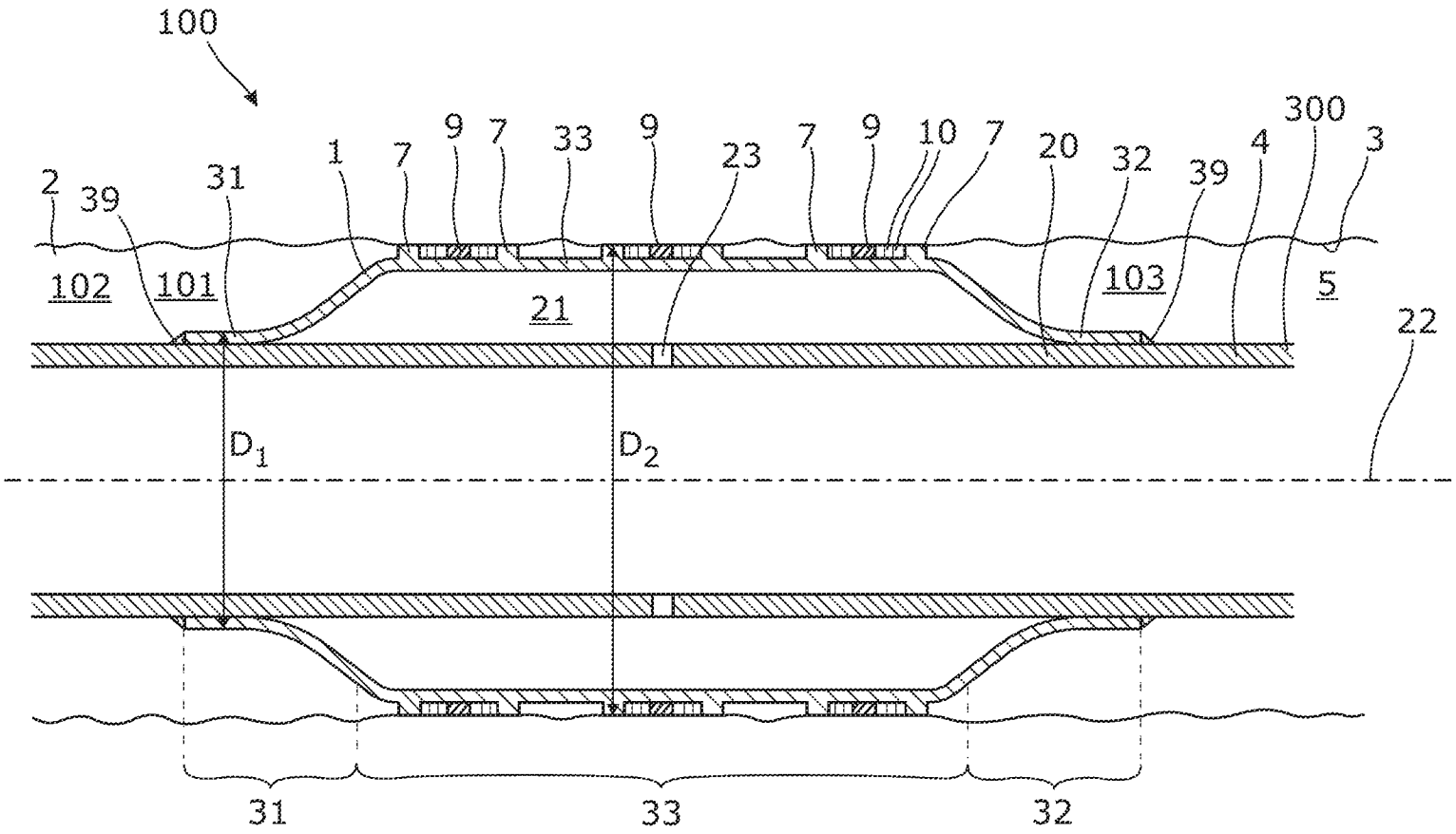
FIG. 6 shows a cross-sectional view of an annular barrier comprising a downhole expandable tubular.
Figure 7:
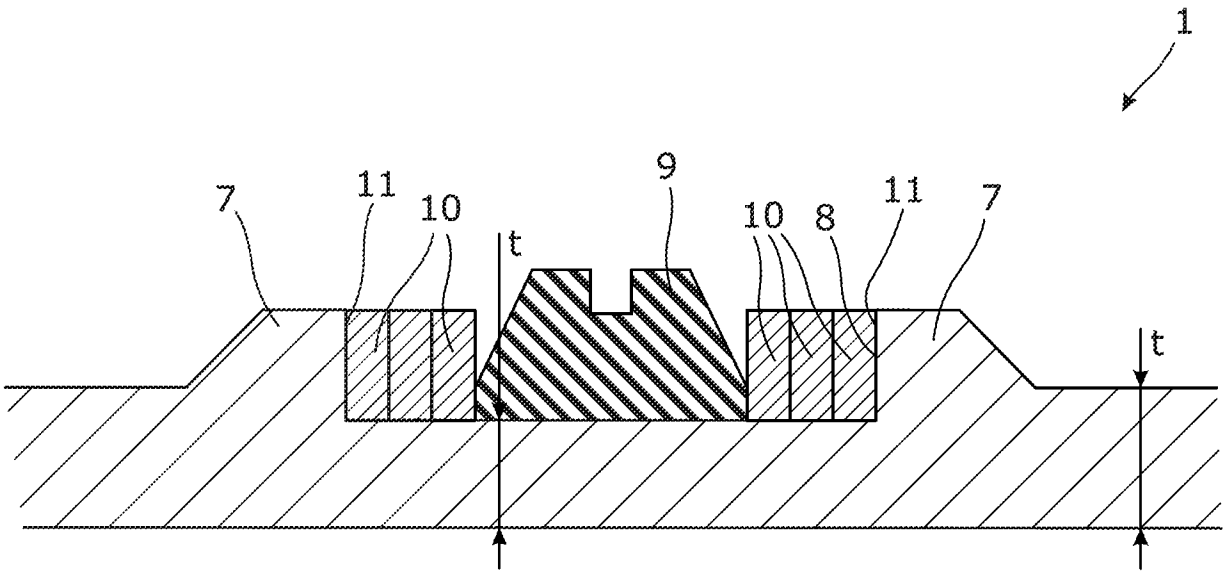
FIG. 7 shows an enlarged cross-sectional view of a downhole expandable tubular having a sealing element and two retainer elements.

In FIG. 7, a sealing element 9 is arranged in the groove 8 and between two projections 7. As can be seen, the thickness t of the expandable tubular 1 is not the same in the groove as between two adjacent projections which are not adjacent the same groove. In another embodiment, the sealing element 9 may be arranged merely between two adjacent projections, so that the downhole expandable tubular 1 does not have grooves and thus has the same thickness t between the projections 7 and opposite the sealing element 9, as shown in FIG. 6.

As shown in FIG. 7, in order to maintain the sealing element 9 in place, also during expansion of the downhole expandable tubular 1, a ring-shaped retainer element 10 is arranged between two adjacent projections 7 or in the groove 8 for pressing the sealing element 9 in the axial extension towards an edge 11 of the projection or groove. The retainer element 10 functions as a back-up ring for the sealing element, so that the sealing element 9 is not squeezed in between the expandable tubular and the inner face of the borehole or casing when the expandable tubular is expanded. The retainer element is a split ring with several windings and is made of a metal material. When the expandable tubular is expanded by 30%, the retainer element 10 is partly "unwound" by 30% of the circumference of the retainer element 10, and thus, the retainer element decreases its number of windings so that it is still capable of pressing the sealing element against the edge of the groove or the projection. As shown, a retainer element 10 is arranged on opposite sides of the sealing element 9, squeezing the sealing element along its circumferential edges. Each retainer element 10 in FIG. 8 has approximately 3.5 windings, and after expansion of the expandable tubular, the retainer element 10 has approximately 2.7 windings and thus maintains its extension in the axial extension of the expandable tubular even though the retainer element has been partly unwound.

The retainer element may also be made of a spring material, so that when the downhole expandable tubular 1 is expanded, the retainer element is also expanded, resulting in an inherent spring force in the retainer element. However, the spring effect of the metal is not essential to the operation of the retainer ring.

Figure 8:
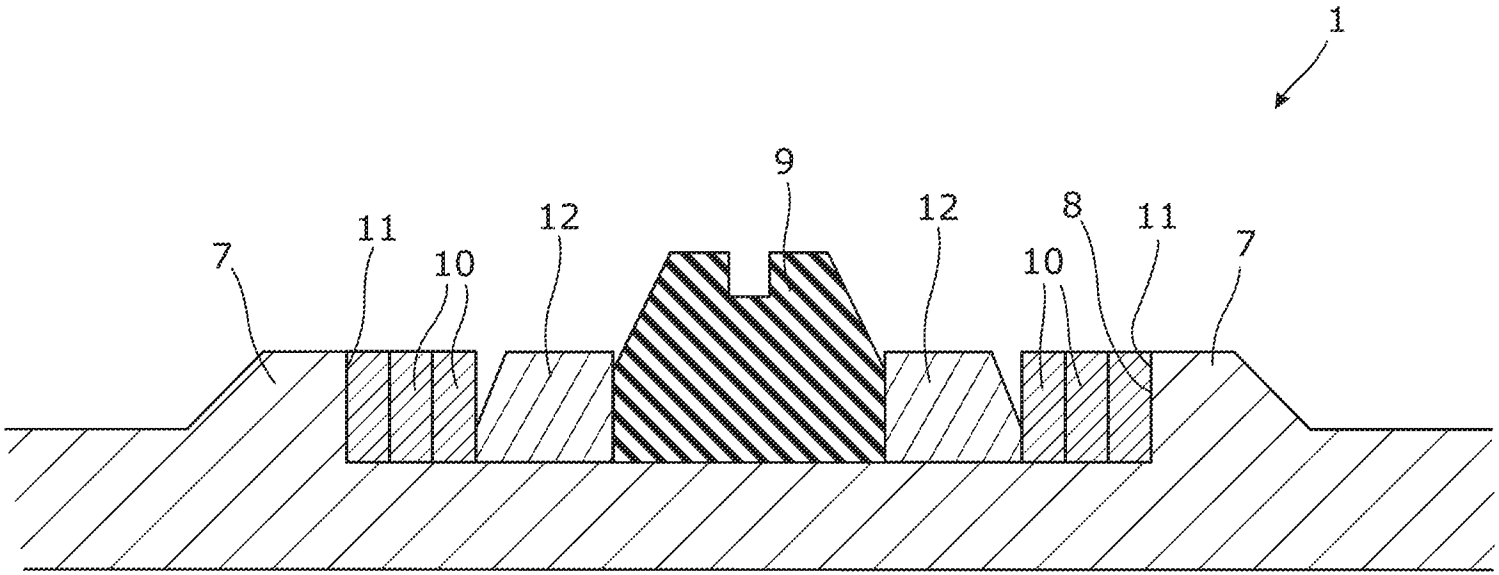
FIG. 8 shows an enlarged cross-sectional view of a downhole expandable tubular having an intermediate element between a sealing element and two retainer elements.

As shown in FIG. 8, a back-up element 12 is arranged between the ring-shaped retaining element 10 and the sealing element 9. The sealing element 9 is typically made of an elastomeric material and the retainer element is made of a metallic material, and in order to protect the sealing element, the back-up element arranged therebetween is made of a non-metal material which is less flexible than the sealing material.

The downhole expandable tubular 1 may also be part of a liner hanger where the downhole expandable tubular has been expanded within an upper casing forming part of a well tubular structure in a well.

Figure 12:
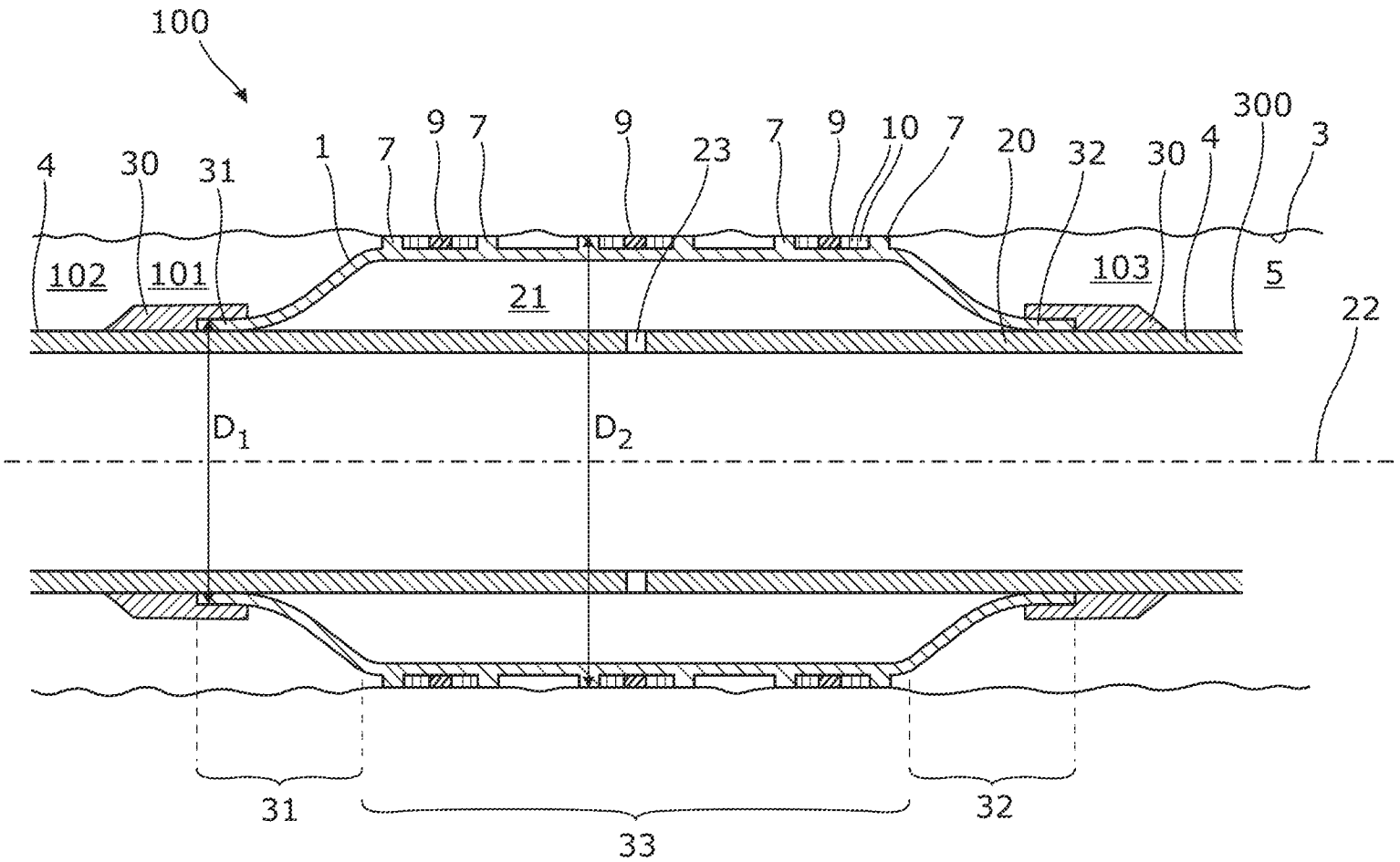
FIG. 12 shows a cross-sectional view of another annular barrier comprising a downhole expandable tubular.

FIG. 6 shows a cross-sectional view of an annular barrier 100 which has been expanded in an annulus 101 between a well tubular structure 300 and an inside face 3 of the borehole 5. The annular barrier provides zone isolation between a first zone 102 and a second zone 103 of the borehole. The annular barrier extends along the longitudinal axis 22 which coincides with the longitudinal axis of the casing and well tubular structure. The annular barrier comprises a tubular part 20 which may be a separate tubular part or a casing part for mounting a part of the well tubular structure 300. Furthermore, the annular barrier comprises the downhole expandable tubular 1 which surrounds the tubular part, and each end 31, 32 of the expandable tubular 1 is connected with the tubular part by means of welded connections, without a connection part as shown in FIG. 12. The welded connections are welded in such a way that they are substantially flush with an outer surface of the tubular part, e.g. they do not protrude beyond the outer surface. The downhole expandable tubular 1 and the tubular part 20 enclose an annular barrier space 21, and an expansion opening 23 is provided in the tubular part through which fluid may enter the space in order to expand the expandable tubular. The downhole expandable tubular 1 is expanded until the sealing elements or the projections abut the inner face 3 of the borehole 5, so that fluid is prevented from flowing freely from the first zone 102 to the second zone 103.

Figure 9:
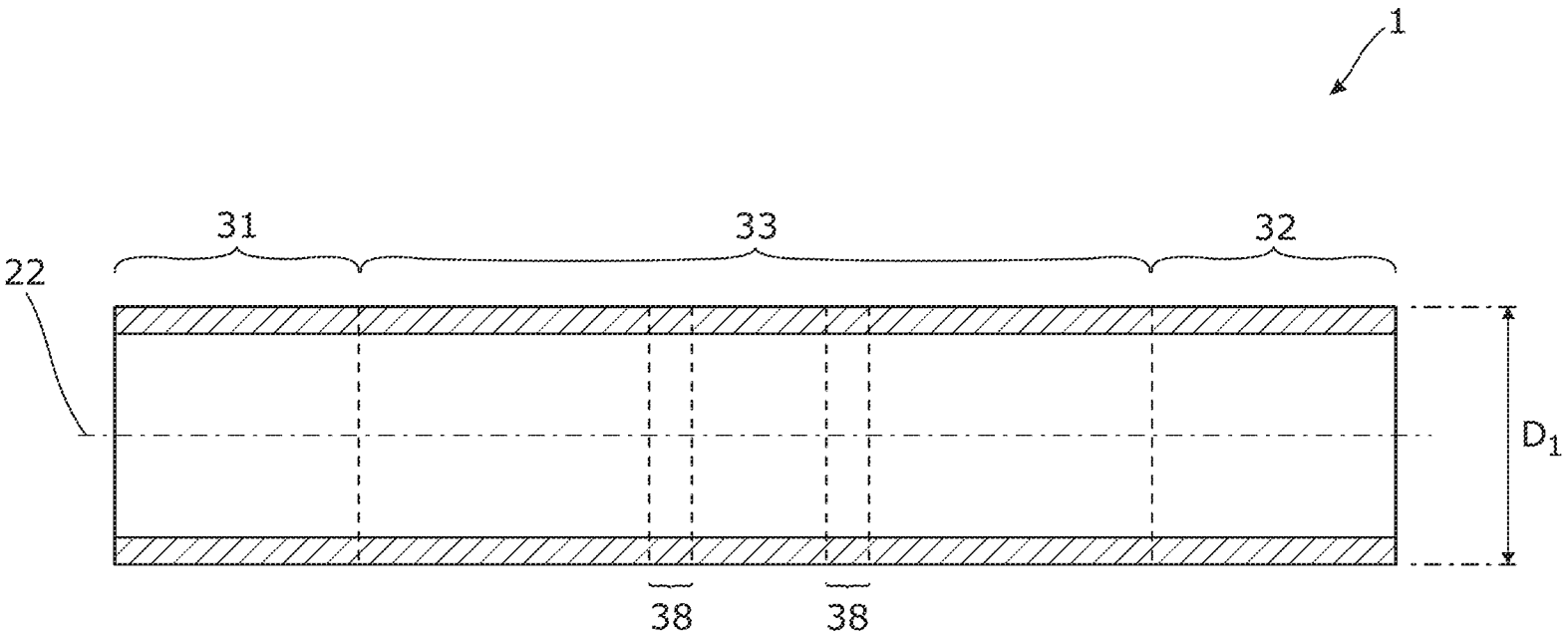
FIG. 9 shows a cross-sectional view of another downhole expandable tubular in its unexpanded condition.
Figure 10:
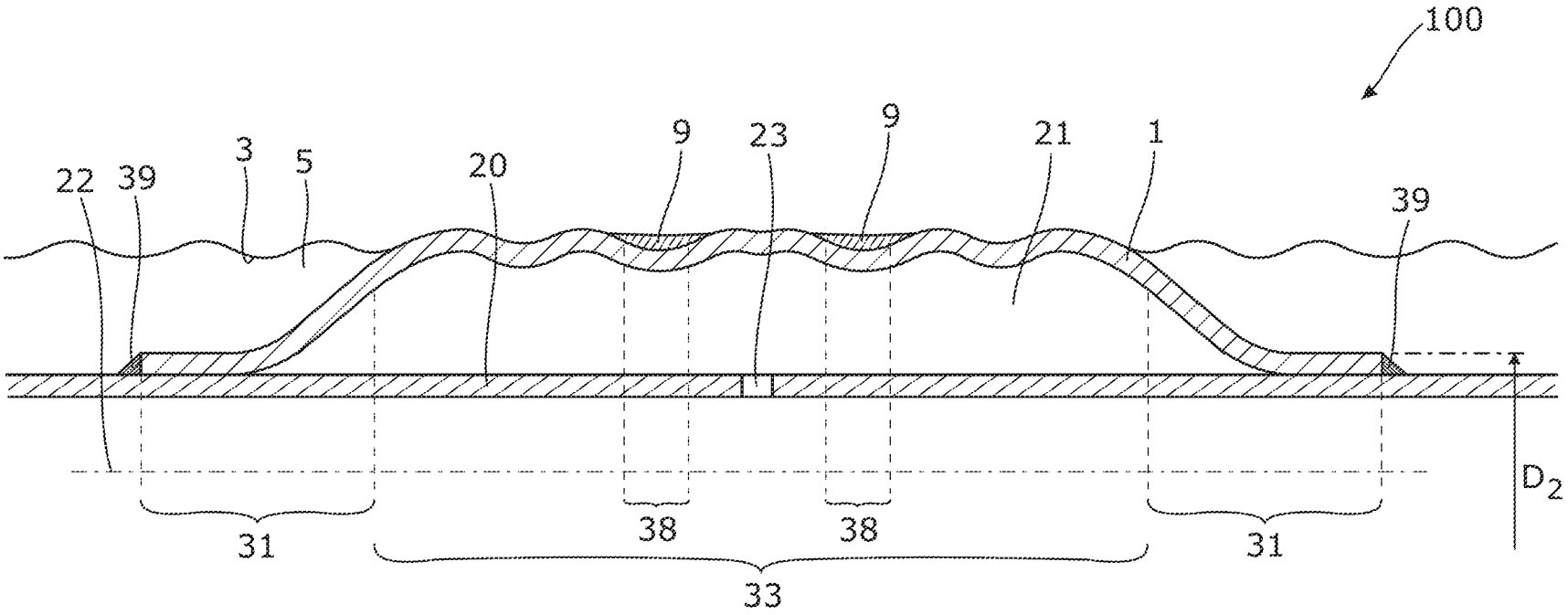
FIG. 10 shows a cross-sectional view of the downhole expandable tubular of FIG. 9 in its expanded condition.

In FIG. 9, the end sections 31, 32 and the intermediate section 33 have substantially the same thickness along the axial extension of the downhole expandable tubular 1. The intermediate section 33 comprises subsections 38 having a higher yield strength than the intermediate section 33. And when expanding the downhole expandable tubular 1 as part of an annular barrier, as shown in FIG. 10, the subsections 38 do not expand as much as the rest of the intermediate section 33. The subsections 38 therefore change the cross-sectional shape of the expanded downhole expandable tubular 1 into an undulated shape, creating cavities between the downhole expandable tubular 1 and the inner face 3 of the borehole 5, strengthening the downhole expandable tubular 1 and substantially increasing the collapse rating of the annular barrier of FIG. 10. The yield strength of the subsections is lower than that of the end sections. The subsections are distributed along the axial extension of the intermediate section with a predetermined distance between them, creating several cavities in which sealing elements 9 are arranged. Thus, the intermediate section may extend between the subsections, so that the expandable tubular has varying yield strengths along the axial extension.

As shown in FIG. 12, the end sections of the downhole expandable tubular may be connected with the tubular part by means of connection parts 30. The connection parts 30 may be configured to protect the downhole expandable tubular when it is being submerged, and the connection parts may also be provided with helical grooves to ease the insertion of the well tubular structure 4 into the borehole.

Figure 11:
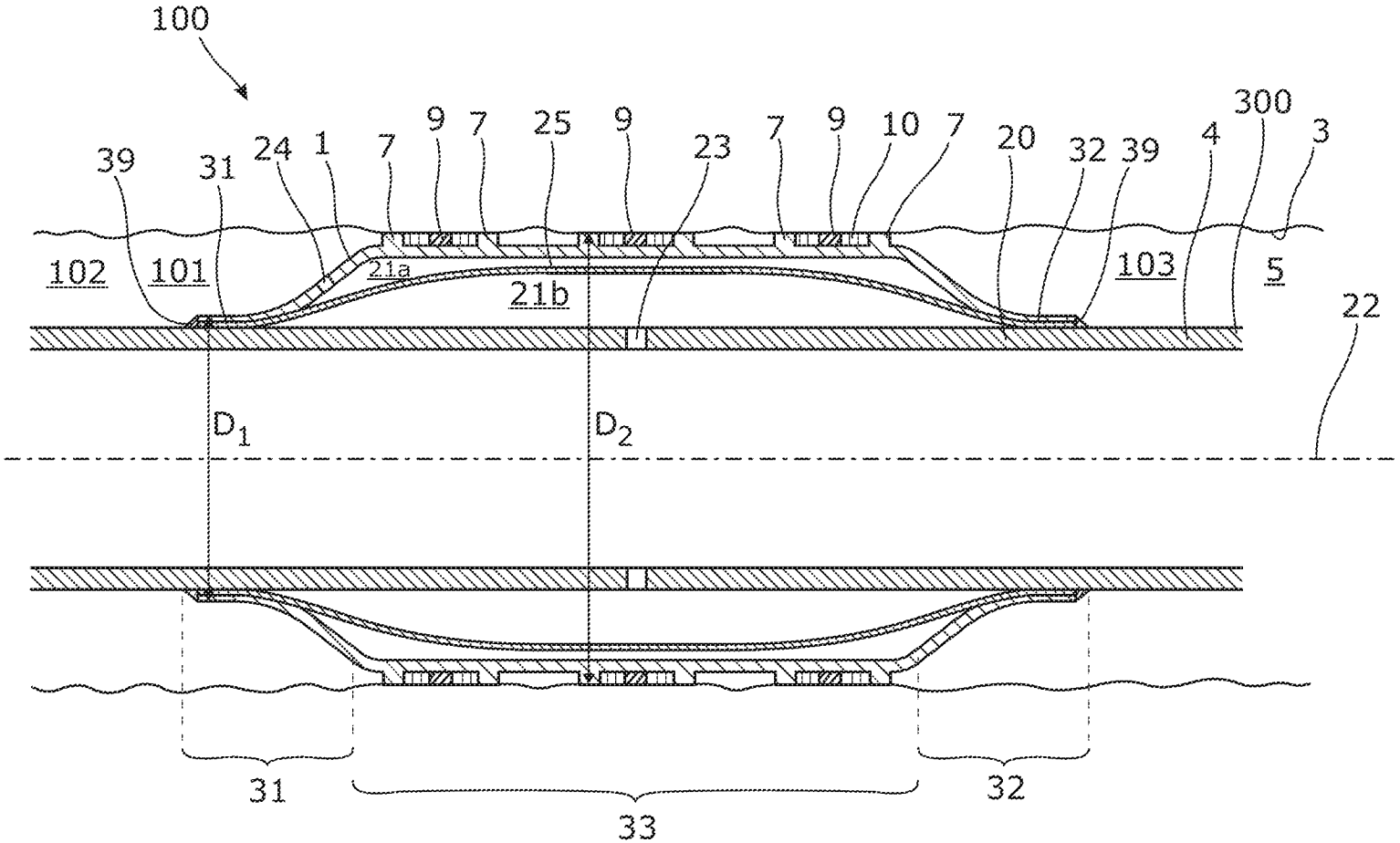
FIG. 11 shows another annular barrier having an intermediate sleeve for equalising the pressure across the downhole expandable tubular.

As shown in FIG. 11, the annular barrier further comprises a sleeve 25 arranged between the downhole expandable tubular 1 and the tubular part 20. The sleeve 25 is connected with the tubular part 20 and the downhole expandable tubular 1, thereby dividing the space into a first space section 21*a* and a second space section 21*b*. The sleeve is squeezed in between the tubular part and the downhole expandable tubular. The sleeve 25 may also be connected with the tubular part in another manner, such as shrink-fitted onto the tubular part. In order to equalise the pressure, the downhole expandable tubular has an opening 24 providing fluid communication between the first zone or the second zone and one of the space sections, thus equalising the pressure between the space and that zone. When e.g. performing hydraulic fracturing or another well treatment, the pressure in one of the zones in which hydraulic fracturing is performed increases, and in order to prevent the expandable tubular from collapsing, the fluid is let in through the opening 24 and into the first space section 21*a*. When exposed to the increased pressure, the sleeve 25 moves towards the tubular part, thus yielding to the increased pressure in the first space section 21*a*, and the first space 21*a* increases until the pressure equalises or the sleeve abuts the tubular part.

The annular barrier space of the annular barrier may comprise at least one thermally decomposable compound adapted to generate gas or super-critical fluid upon decomposition. This compound may be thermally decomposable below a temperature of 400° C. and above 100° C., preferably above 180° C. Thus, the downhole expandable tubular of the annular barrier may be expanded by supplying heat to the annular barrier instead of pressurised fluid. The compound may comprise nitrogen in the form of ammonium, nitrite, azide or nitrate or be selected from a group consisting of: ammonium dichromate, ammonium nitrate, ammonium nitrite, barium azide, sodium nitrate or a combination thereof.

The metal material of the end sections after being metal worked has a yield strength of 250-1000 MPa at room temperature, preferably 300-700 MPa at room temperature. The metal material of the intermediate section after being metal-worked has a yield strength of 200-400 MPa at room temperature, preferably 200-350 MPa at room temperature.

The tubular blank may be made of any kind of metal, such as iron, steel or stainless steel, or more ductile materials, such as copper, aluminium, lead, tin, nickel, or a combination thereof. By blank is meant a preform or similar intermediate product.

Cold-working may be performed by rollers pressing on the outer face of the blank or downhole expandable tubular while the rollers are moved along the axial extension, extending the length of the blank or downhole expandable tubular along the axial extension and decreasing the thickness of the blank or downhole expandable tubular.

The expansion of the downhole expandable tubular may be performed by tool isolation of a section of the well tubular structure opposite the opening 23 in the tubular part 20 of the annular barrier of FIG. 6, and then pressurising that section.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure, casing or production casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the present technology has been described in the above in connection with certain examples, it will be evident for a person skilled in the art that several modifications are conceivable without departing from the present technology.

The invention claimed is:

1. An annular barrier to be expanded in an annulus between a well tubular structure and an inside face of a casing or borehole downhole for providing zone isolation between a first zone and a second zone of the casing or borehole, the annular barrier extending along a longitudinal axis, the annular barrier comprising:

a tubular part, the tubular part being a separate tubular part or a casing part for mounting as part of the well tubular structure, a downhole expandable tubular to be expanded in the annulus downhole from a first outer diameter to a second outer diameter to abut against the inner face of the casing or borehole, the downhole expandable tubular having a first end section, a second end section and an intermediate section extends from the first end section to the second end section, and the downhole expandable tubular surrounding the tubular part, said first and second end sections of the downhole expandable tubular being connected with the tubular part and extending along the axis, and an annular barrier space between the tubular part and the downhole expandable tubular, wherein the downhole expandable tubular comprises a one piece construction of metal material, each of the first and second end sections having a higher yield strength than the intermediate section along an entire length of the intermediate section, wherein the first and second end sections are treated to achieve the higher yield strength to at least partly prevent the first and second end sections from departing from the tubular part, and wherein the first end section has a length that is substantially equal to a length of the second end section.

2. An annular barrier according to claim 1, wherein the first and second end sections of the downhole expandable tubular are welded onto the tubular part.

3. An annular barrier according to claim 2, wherein the higher yield strength is achieved via cold-working.

4. An annular barrier according to claim 1, wherein the metal material of the end sections has a higher yield strength than the metal material of the intermediate section after metal-working of the end sections or the intermediate section.

5. An annular barrier according to claim 1, wherein the end sections are cold-worked or the intermediate section is heat-treated, annealed or induction-annealed.

6. An annular barrier according to claim 1, wherein the yield strength of the metal material of the end sections is at least 25% higher than the yield strength of the material of the intermediate section.

7. An annular barrier according to claim 1, wherein the yield strength of the metal material of the end sections is at least 350 MPa.

8. An annular barrier according to claim 1, wherein the end sections and the intermediate section have substantially the same thickness along the longitudinal axis.

9. An annular barrier according to claim 1, wherein the tubular comprises steel or stainless steel.

10. An annular barrier according to claim 1, further comprising at least one sealing element surrounding the downhole expandable tubular.

11. An annular barrier according to claim 1, further comprising an expansion opening in the tubular part through which fluid may enter the space in order to expand the expandable tubular.

12. A downhole completion system comprising:

a well tubular structure, and the annular barrier according to claim 1.

13. A manufacturing method for manufacturing a downhole expandable tubular of an annular barrier to be expanded in an annulus between a well tubular structure and an inside face of a casing or borehole downhole for providing zone isolation between a first zone and a second zone of the casing or borehole, the annular barrier extending along a longitudinal axis, the annular barrier comprising:

a tubular part, the tubular part being a separate tubular part or a casing part for mounting as part of the well tubular structure, the downhole expandable tubular configured to be expanded in the annulus downhole from a first outer diameter to a second outer diameter to abut against the inner face of the casing or borehole, the downhole expandable tubular having a first end section, a second end section and an intermediate section extends from the first end section to the second end section, and the downhole expandable tubular surrounding the tubular part, said first and second end sections of the downhole expandable tubular being connected with the tubular part and extending along the axis, and an annular barrier space between the tubular part and the downhole expandable tubular, wherein the downhole expandable tubular comprises a one piece construction of metal material, each of the first and second end sections having a higher yield strength than the intermediate section along an entire length of the intermediate section, and wherein the first and second end sections are treated to achieve the higher yield strength to at least partly prevent the first and second end sections from departing from the tubular part, the method comprising:

providing a metal tubular blank made of a metal material, and metal-working the end sections so that the metal material of the end sections has a higher yield strength than the metal material of the intermediate section.

14. A manufacturing method according to claim 13, wherein the metal-working comprises:

cold-working the intermediate section to a thickness which is smaller than that of the end sections, heat-treating the intermediate section, and cold-working the end sections.

15. A manufacturing method according to claim 13, wherein the metal-working comprises:

cold-working the intermediate section and the end sections, and heat-treating the intermediate section.

16. An annular barrier to be expanded in an annulus between a well tubular structure and an inside face of a casing or borehole downhole for providing zone isolation between a first zone and a second zone of the casing or borehole, the annular barrier extending along a longitudinal axis, the annular barrier comprising:

a tubular part, the tubular part being a separate tubular part or a casing part for mounting as part of the well tubular structure, a downhole expandable tubular to be expanded in the annulus downhole from a first outer diameter to a second outer diameter to abut against the inner face of the casing or borehole, the downhole expandable tubular having a first end section, a second end section and an intermediate section extends from the first end section to the second end section, and the downhole expandable tubular surrounding the tubular part, said first and second end sections of the downhole expandable tubular being connected with the tubular part and extending along the axis, and an annular barrier space between the tubular part and the downhole expandable tubular, wherein the downhole expandable tubular comprises a one piece construction of metal material, each of the first and second end sections having a higher yield strength than the intermediate section along an entire length of the intermediate section, and wherein the first and second end sections are treated to achieve the higher yield strength to at least partly prevent the first and second end sections from departing from the tubular part, wherein the first and second end sections of the downhole expandable tubular are welded onto the tubular part without any connection parts.

17. An annular barrier to be expanded in an annulus between a well tubular structure and an inside face of a casing or borehole downhole for providing zone isolation between a first zone and a second zone of the casing or borehole, the annular barrier extending along a longitudinal axis, the annular barrier comprising:

a tubular part, the tubular part being a separate tubular part or a casing part for mounting as part of the well tubular structure, a downhole expandable tubular to be expanded in the annulus downhole from a first outer diameter to a second outer diameter to abut against the inner face of the casing or borehole, the downhole expandable tubular having a first end section, a second end section and an intermediate section extends from the first end section to the second end section, and the downhole expandable tubular surrounding the tubular part, said first and second end sections of the downhole expandable tubular being connected with the tubular part and extending along the axis, and an annular barrier space between the tubular part and the downhole expandable tubular, wherein the downhole expandable tubular comprises a one piece construction of metal material, each of the first and second end sections having a higher yield strength than the intermediate section along an entire length of the intermediate section, and wherein the first and second end sections are treated to achieve the higher yield strength to at least partly prevent the first and second end sections from departing from the tubular part, wherein the intermediate section is dimensioned to seal with the casing or borehole, and the first and second end sections are not dimensioned to seal with the casing or borehole.

18. An annular barrier to be expanded in an annulus between a well tubular structure and an inside face of a casing or borehole downhole for providing zone isolation between a first zone and a second zone of the casing or borehole, the annular barrier extending along a longitudinal axis, the annular barrier comprising:

a tubular part, the tubular part being a separate tubular part or a casing part for mounting as part of the well tubular structure, a downhole expandable tubular to be expanded in the annulus downhole from a first outer diameter to a second outer diameter to abut against the inner face of the casing or borehole, the downhole expandable tubular having a first end section, a second end section and an intermediate section extends from the first end section to the second end section, and the downhole expandable tubular surrounding the tubular part, said first and second end sections of the downhole expandable tubular being connected with the tubular part and extending along the axis, and an annular barrier space between the tubular part and the downhole expandable tubular, wherein the downhole expandable tubular comprises a one piece construction of metal material, each of the first and second end sections having a higher yield strength than the intermediate section along an entire length of the intermediate section, and wherein the first and second end sections are treated to achieve the higher yield strength to at least partly prevent the first and second end sections from departing from the tubular part, wherein the intermediate section alone defines a sealing/engagement section and the first and second end sections are positioned outside of the sealing/engagement section.

* * * * *